US009930454B2

(12) United States Patent
van't Hof et al.

(10) Patent No.: US 9,930,454 B2
(45) Date of Patent: Mar. 27, 2018

(54) METHOD AND SYSTEM FOR TESTING A MOULD SHAPE QUALITY OF A USER-CUSTOMIZED EAR MOULD

(71) Applicant: Dynamic Ear Company B.V., Delft (NL)

(72) Inventors: Pieter Gerard van't Hof, Delft (NL); Engbert Wilmink, Delft (NL)

(73) Assignee: DYNAMIC EAR COMPANY B.V., Delft (NL)

( * ) Notice: Subject to any disclaimer, the term of this patent is extended or adjusted under 35 U.S.C. 154(b) by 0 days.

(21) Appl. No.: 15/024,537

(22) PCT Filed: Oct. 2, 2014

(86) PCT No.: PCT/NL2014/050679
§ 371 (c)(1),
(2) Date: Mar. 24, 2016

(87) PCT Pub. No.: WO2015/050446
PCT Pub. Date: Apr. 9, 2015

(65) Prior Publication Data

US 2016/0241967 A1 Aug. 18, 2016

(30) Foreign Application Priority Data

Oct. 3, 2013 (NL) ..... 2011551

(51) Int. Cl.
*H04R 25/00* (2006.01)

(52) U.S. Cl.
CPC ..... *H04R 25/30* (2013.01); *H04R 2225/025* (2013.01); *H04R 2460/15* (2013.01)

(58) Field of Classification Search
CPC ..... H04R 25/30; H04R 2225/025; H04R 2460/15
See application file for complete search history.

(56) References Cited

U.S. PATENT DOCUMENTS 6,567,524 B1 * 5/2003 Svean ..... G01H 3/14 381/314
2007/0291971 A1 * 12/2007 Halteren ..... H04R 25/48 381/322

(Continued)

FOREIGN PATENT DOCUMENTS

EP 2 317 773 5/2001
EP 1 465 454 10/2004

(Continued)

OTHER PUBLICATIONS

Hamilton, In Ear Headphones Part II: Custom Fits, Jul. 5, 2007, The Ipod Observer, whole article.*

(Continued)

*Primary Examiner* — Sonia Gay
(74) *Attorney, Agent, or Firm* — Pillsbury Winthrop Shaw Pittman, LLP

(57) ABSTRACT

The present disclosure concerns a method for determining a mold shape quality (Q) of an ear mold (2) customized to an ear canal (31) of a user by means of a mold testing system (100). The mold testing system (100) comprises an acoustic generator (3) and a microphone (4) arranged in a test housing (1) with an open end (1*c*) that is connectable to an inner passage (2*c*) of the custom ear mold (2). The method comprises inserting the ear mold (2) into the ear canal (31); connecting the test housing (1) to the ear mold (2); generating an acoustic signal (Sg) into the ear canal (31) via the inner passage (2*c*); measuring the acoustic signal (Sr) from the ear canal (31); comparing the measured signal (Sm) with a reference signal (Se); and providing a feedback signal (Sf) based on the said comparison. The feedback signal (Sf) is a measure for the mold shape quality (Q) of the custom ear mold (2).

19 Claims, 7 Drawing Sheets

(56) References Cited

U.S. PATENT DOCUMENTS

| | | | | |
|---|---|---|---|---|
| 2010/0074451 | A1 | 3/2010 | Usher et al. | |
| 2010/0322454 | A1* | 12/2010 | Ambrose | H04R 1/1016 381/380 |
| 2011/0116643 | A1 | 5/2011 | Tiscareno et al. | |
| 2013/0170660 | A1* | 7/2013 | Kristensen | H04R 25/305 381/60 |
| 2013/0195281 | A1* | 8/2013 | Chiang | H04R 25/30 381/60 |

FOREIGN PATENT DOCUMENTS

| | | |
|---|---|---|
| EP | 1 674 059 | 6/2006 |
| WO | WO 2012/093343 | 7/2012 |

OTHER PUBLICATIONS

International Search Report for PCT/NL2014/050679 dated Jan. 21, 2015.

* cited by examiner

METHOD AND SYSTEM FOR TESTING A MOULD SHAPE QUALITY OF A USER-CUSTOMIZED EAR MOULD

CROSS-REFERENCE TO RELATED APPLICATIONS

This is the U.S. National Stage of PCT/NL2014/050679, filed Oct. 2, 2014, which in turn claims priority to Netherlands Application No. 2011551, filed Oct. 3, 2013, the entire contents of both applications being incorporated herein by reference in their entireties.

TECHNICAL FIELD AND BACKGROUND

The present disclosure concerns a method for determining a mould shape quality of a user-customized ear mould for an ear piece by means of a mould testing system; the disclosure further concerns a mould testing system for determining a mould shape quality of a user-customized ear mould for an ear piece.

An ear piece is worn in the ear of a user to provide a desired functionality, e.g. hearing aid. The ear piece typically comprises an outer shape or contour designed to fit at least partly into an ear canal. By its outer shape, the ear piece can e.g. be retained in the ear without further support. For some ear pieces it can be desirable that the ear piece acoustically fits into the ear canal, e.g. to block outside noise and/or prevent deterioration of sound generated by the ear piece.

One class of ear pieces has a universal shape that is designed to more or less adapt their shape to the ear of an average individual. Unfortunately, for a universal ear piece, a trade-off is made between the requirement to adapt to different ear shapes by resilient expansion of the outer shape and a comfort level of the user who constantly feels the resilient housing of the ear piece trying to expand inside his ear canal.

Another class of ear pieces are customized to a specific user. The customized ear piece typically comprises a user-customized ear mould with an outer contour moulded to conform with an ear canal of the specific user. An advantage of a user-customized ear piece over a universal ear piece (e.g. "ear buds"), is that an improved sound quality can be achieved at a desired comfort level. One type of customized ear mould comprises an inner passage through the ear mould that is, in use, directed into the ear canal to be in acoustic communication therewith. The inner passage can be fitted with a functional housing, e.g. comprising an acoustic generator, to provide the desired functionality, e.g. hearing aid. Generally, the inner passage of the ear mould has a universal shape such that the functional housing fitted therein can also be universal.

While it is recognized that a proper mould shape quality is important, presently known mould testing systems, e.g. used by audiologists for testing the mould shape of a customized ear mould, have some shortcomings. In particular, the present test system consist of a tube that is connected on one side to the ear mould under test. On the other side, the tube is connected to a pump and a pressure sensor. The shape conformity of the ear mould is tested in situ, i.e. when properly placed in the ear canal. When this is the case, the pump applies a specific over or under pressure to the volume that consists of the tube, the earpiece canal and the cavity in the ear before the tympanic membrane. During pumping the pressure is monitored with the pressure sensor. When the right pressure is reached, the pumping stops. After that the pressure in the volume is monitored during at least five seconds. The worse the shape conformity between the mould and the ear canal is, the faster the pressure will go back to the atmospheric pressure that was in it before. On the other hand, with a perfectly fitting shape the pressure in the volume will stay constant.

When an appropriate pressure is chosen, the method can work. However the pumping makes a lot of noise in the ear. Secondly, either over or under pressure gives an unpleasant feeling, since the tympanic membrane is stretched. Thirdly overpressure tends to push out the ear mould out of the more or less wedge shaped ear canal, which could lead to the unfair judgement that the mould shape does not fit. On the other hand under pressure could lead to sucking in the earpiece, which could lead to the unfair judgement that the mould shape does fit. Finally, the equipment for testing the mould shape as described above is expensive. These and other drawbacks leads to the situation that the mould shape quality is often not tested, whereas this is very important. Especially, because the acoustic fit of a set of customized ear mould will in general be guaranteed for at least two years by the supplier. It is thus highly desirable to determine the mould shape quality when the ear moulds are handed over to the customer in order to have a good starting point.

Accordingly, there is a desire for an improved method for determining mould shape quality of a user-customized ear mould for an ear piece by means of a mould testing system alleviating the above-mentioned shortcomings.

SUMMARY

Thereto, the present disclosure provides a method for determining a mould shape quality of a user-customized ear mould for an ear piece by means of a mould testing system. The ear mould comprises an outer contour moulded to conform with an ear canal of an ear; and an inner passage through the ear mould that is in use directed into the ear canal to be in acoustic communication therewith. Advantageously, the mould testing system comprises an acoustic generator and a microphone arranged in a test housing with an open end that is connectable to the inner passage of the ear mould. The method comprises inserting the ear mould into the ear canal; connecting the test housing with the open end to the inner passage of the ear mould; using the acoustic generator for generating an acoustic signal into the ear canal via the inner passage; using the microphone for measuring an acoustic signal from the ear canal; comparing the measured signal with a reference signal; and providing a feedback signal based on the said comparison wherein the feedback signal is a measure for the mould shape quality of the ear mould.

It is recognized that a customized ear mould that is not correctly shaped to fit the ear canal can lead to diminished user comfort and deteriorated quality of the sound. By measuring the acoustic signal in the ear, a deteriorated mould shape quality can be detected as a decrease in the registered signal compared to the generated signal. By using sound waves instead of over/under pressure, disadvantages of pressure based testing systems can be avoided. Advantageously, a test housing comprising a speaker and microphone can be reversibly connected to the ear mould to test the mould shape quality and after the test is complete, be replaced with the functional housing of the ear piece, i.e. the housing used by the end-user. It will be appreciated that the end-user does not need to carry around the microphone in his ear piece once the test of the ear mould has been passed, i.e. the functional housing may comprise an acoustic generator only. For example, the test housing can be connected to the ear mould by means of a clamping structure, e.g. a rim of the test housing that fits into an opposing slot in the inner passage of the ear mould. It is found that a test signal can be particularly sensitive to mould shape quality when it is generated at low frequency, e.g. between 15 and 50 Hz. Furthermore, by additionally using a higher frequency reference signal, e.g. above 100 Hz, a relative decrease of the low frequency test signal compared to the high frequency reference signal can be a measure for the mould shape quality of the ear mould.

The present disclosure also provides a mould testing system for determining a mould shape quality of a user-customized ear mould for an ear piece, e.g. for use in a method as detailed above. The mould testing system comprises an acoustic generator and a microphone arranged in a test housing with an open end that is connectable to the inner passage of the ear mould. The mould testing system further comprises a signal generator arranged for providing a driving signal to the acoustic generator for generating an acoustic signal; a signal receiver arranged for receiving a measured signal from the microphone based on a registered signal by the microphone; and a feedback circuit arranged for comparing the measured signal with a reference signal and providing a feedback signal based on the said comparison wherein the feedback signal is a measure for the mould shape quality of the ear mould.

BRIEF DESCRIPTION OF DRAWINGS

These and other features, aspects, and advantages of the methods and systems of the present disclosure will become better understood from the following description, appended claims, and accompanying drawing wherein:

DESCRIPTION OF EMBODIMENTS

Figure 1:
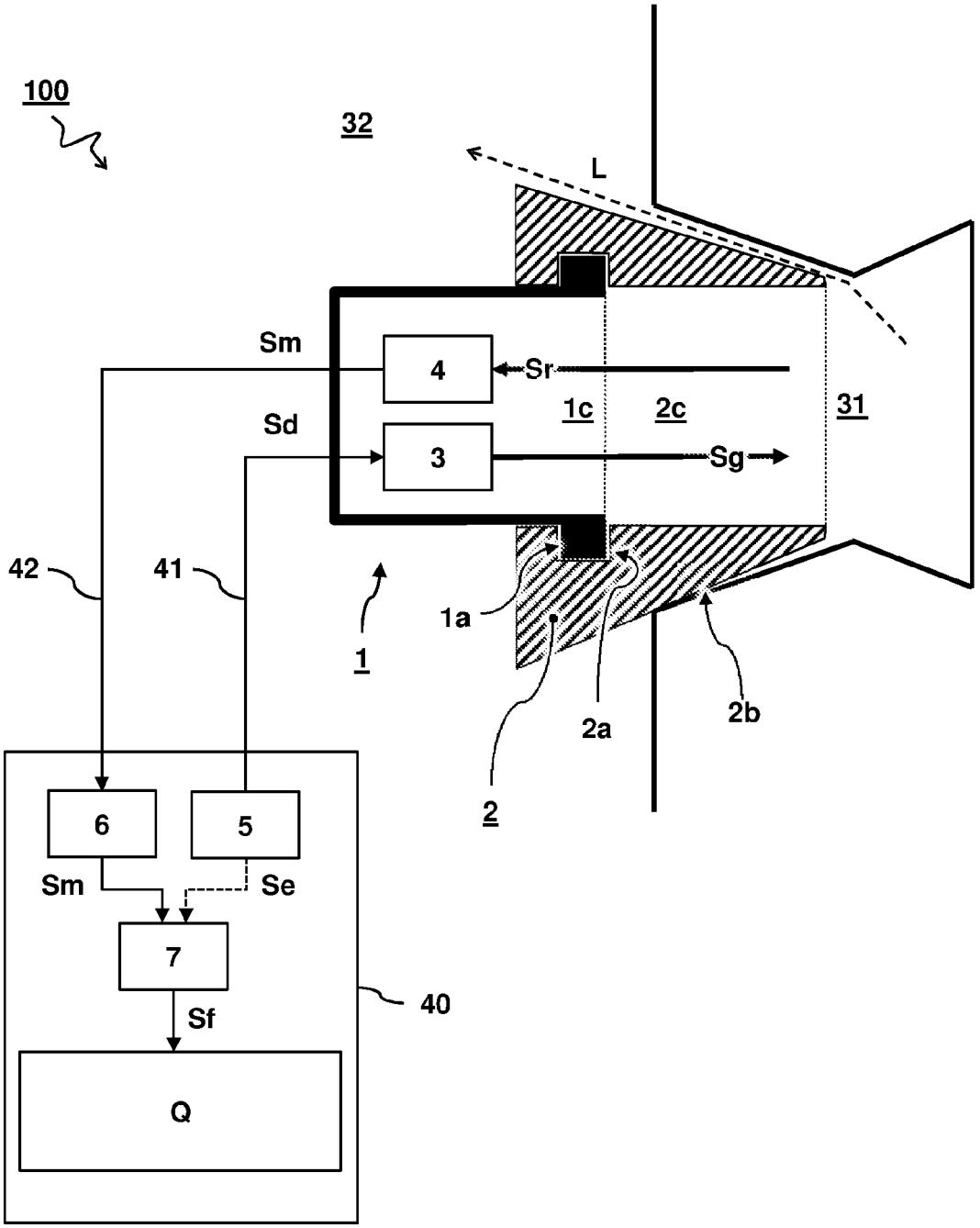
FIG. 1 shows a schematic illustration of an ear mould connected to a mould testing system.

Unless otherwise defined, all terms (including technical and scientific terms) used herein have the same meaning as commonly understood by one of ordinary skill in the art to which this invention belongs as read in the context of the description and drawings. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In some instances, detailed descriptions of well-known devices and methods may be omitted so as not to obscure the description of the present systems and methods. Terminology used for describing particular embodiments is not intended to be limiting of the invention. As used herein, the singular forms "a", "an" and "the" are intended to include the plural forms as well, unless the context clearly indicates otherwise. The term "and/or" includes any and all combinations of one or more of the associated listed items. It will be understood that the terms "comprises" and/or "comprising" specify the presence of stated features but do not preclude the presence or addition of one or more other features. It will be further understood that when a particular step of a method is referred to as subsequent to another step, it can directly follow said other step or one or more intermediate steps may be carried out before carrying out the particular step, unless specified otherwise. Likewise it will be understood that when a connection between structures or components is described, this connection may be established directly or through intermediate structures or components unless specified otherwise. All publications, patent applications, patents, and other references mentioned herein are incorporated by reference in their entirety. In case of conflict, the present specification, including definitions, will control.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. The description of the exemplary embodiments is intended to be read in connection with the accompanying drawings, which are to be considered part of the entire written description. In the drawings, the absolute and relative sizes of systems, components, layers, and regions may be exaggerated for clarity. Embodiments may be described with reference to schematic and/or cross-section illustrations of possibly idealized embodiments and intermediate structures of the invention. In the description and drawings, like numbers refer to like elements throughout. Relative terms as well as derivatives thereof should be construed to refer to the orientation as then described or as shown in the drawing under discussion. These relative terms are for convenience of description and do not require that the system be constructed or operated in a particular orientation unless stated otherwise.

FIG. 1 shows a schematic illustration of a user-customized ear mould 2 connected to a mould testing system 100.

The ear mould 2 comprises an outer contour 2*b* moulded to conform with an ear canal 31 of an ear. The ear mould 2 further comprises an inner passage 2*c* through the ear mould 2 that is in use directed into the ear canal 31 to be in acoustic communication therewith.

The mould testing system 100 comprises a test housing 1. The test housing 1 comprises an acoustic generator 3 and a microphone 4. The test housing 1 has an open end 1*c* that is connectable to the inner passage 2*c* of the ear mould 2. In one embodiment, the test housing 1 is shaped as a cup, i.e. a sleeve like structure with an opening 1*c* on one end only.

The cup closes off a closed volume including the inner passage 2*c* and the ear canal 31. Preferably, the test housing 1 is reversibly connectable to the ear mould 2 to form the closed volume with the ear canal 31, wherein the closed volume comprises the acoustic generator 3 and the microphone 4. It will be appreciated that when the mould shape quality has passed the test, the test housing 1 can be replaced with the functional housing 11 (shown in FIG. 2) to form the ear piece 10 of the end-user equipment, e.g. a hearing aid. In this way the end-user does not have to carry around unnecessary equipment in his ear once the test is complete.

In one embodiment, the inner passage 2*c* of the ear mould 2 comprises a clamping structure 2*a* arranged for holding a functional housing 11 of the earpiece 10 into the inner passage 2*c*. The test housing 1 comprises an outer contour 1*a* that fits to the clamping structure 2*a* for connecting the test housing 1 with the open end 1*c* to the inner passage 2*c*. In one embodiment, the clamping structure 2*a* and/or outer contour 1*a* comprises a rim that fits into an opposing slot.

In one embodiment, the mould testing system 100 comprises a signal generator 5 arranged for providing a driving signal Sd to the acoustic generator 3 for generating an acoustic signal Sg. In one embodiment, the mould testing system 100 comprises a signal receiver 6 arranged for receiving a measured signal Sm from the microphone 4 based on a registered signal Sr by the microphone 4. In one embodiment, the mould testing system 100 comprises a feedback circuit 7 arranged for comparing the measured signal Sm with a reference signal Se and providing a feedback signal Sf based on the said comparison wherein the feedback signal Sf is a measure for the mould shape quality Q of the ear mould 2.

In one embodiment, the signal generator 5 provides a reference signal Se to the feedback circuit 7, e.g. comprising information on the frequency and loudness of the generated signal Sg. Alternatively or in addition, a fixed reference signal can be stored in the system and used to compare to the measured signal Sm. Alternatively or in addition, the reference signal Se is received via the microphone 4 as a second signal at a different (reference) frequency. In one embodiment, the reference signal Se is provided by a calibration unit.

In one embodiment, the acoustic signal Sg comprises a test signal in a low frequency range between 15-50 Hz. Leakage "L" of the test signal to the external surroundings 32 can be measured by the microphone 4 (indirectly) as a decreased signal Sr in the said low frequency range. The decrease can be a measure for the mould shape quality Q of the ear mould 2.

In one embodiment, the acoustic signal Sg comprises a reference signal in a high frequency range above 100 Hz. The signal Sr is measured by the microphone 4 both in the low frequency and high frequency ranges. A relative decrease of the low frequency test signal compared to the high frequency reference signal is a measure for the mould shape quality Q of the ear mould 2. Alternatively or in addition, more elaborate sound patterns, e.g. with multiple frequencies and/or volume, can be used to obtain the relevant information for detection of the quality of the mould shape quality.

The signal generator 5, signal receiver 6, and feedback circuit 7 can e.g. be comprised in a test equipment housing 40 that is connected or connectable to the test housing 1 by means of wiring 41 and 42. The driving signal Sd can e.g. be sent to the acoustic generator 3 by wiring 41 and the measured signal Sm can be received from the microphone 4 by wiring 42. The wiring can e.g. be connected to a TRRS-socket. Alternative to wiring 41 and 42, the signals Sd and Sm may also be transmitted wirelessly. Some or all of the parts 5,6,7 can also be integrated into or outside the test housing 1.

One method for determining a mould shape quality Q of the user-customized ear mould 2 comprises inserting the ear mould 2 into the ear canal 31. The method further comprises connecting the test housing 1 with the open end 1*c* to the inner passage 2*c* of the ear mould 2. The method further comprises using the acoustic generator 3 for generating an acoustic signal Sg into the ear canal 31 via the inner passage 2*c*. The method further comprises using the microphone 4 for measuring an acoustic signal Sr from the ear canal 31. The method further comprises comparing the measured signal Sm with a reference signal Se. The method further comprises providing a feedback signal Sf based on the said comparison wherein the feedback signal Sf is a measure for the mould shape quality Q of the ear mould 2.

Figure 2:
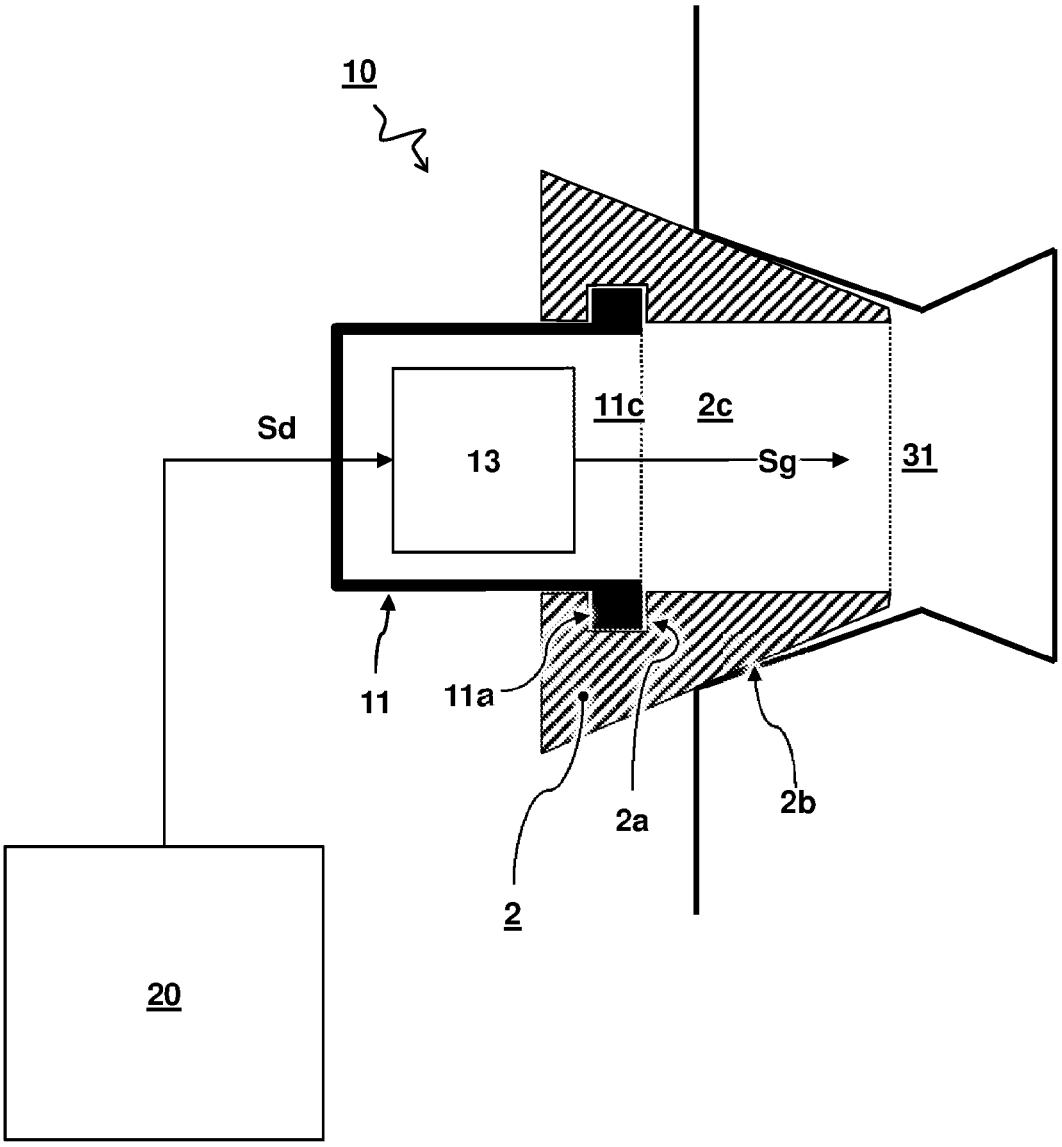
FIG. 2 shows a schematic illustration of an ear mould with a functional housing forming an ear piece.

FIG. 2 shows the user-customized ear mould 2 connected to a functional housing 11 to form an ear piece 10. The term 'functional housing' is used to refer to the component 11 that fits to the custom ear mould 2 to complete the ear piece for the end-user. For example, in one embodiment, the functional housing 11 comprises an acoustic generator 13 connectable to a hearing aid 20 or other sound source. It is appreciated that the functional housing is similar in structure to the test housing of FIG. 1, e.g. also comprising an open end 11*c* that connects to the same ear mould 2, e.g. by clamping structure 11*a*. In this way the customized ear mould can be first tested by the testing system 100 and after mould shape quality is deemed okay, the test housing 1 can be replaced with the functional housing 11. It will also be appreciated that, unlike the test housing 1, the functional housing 11 does not require a microphone or corresponding wiring. The end-user of the ear piece 10 thus has an advantage that he does not have to carry unnecessary equipment or wiring. In one embodiment, instead of replacing the whole housing, only some parts of the housing and/or wiring are replaced, removed, or modified, to convert the test housing for the mould shape test into the functional housing for the end-user.

Figure 3A:
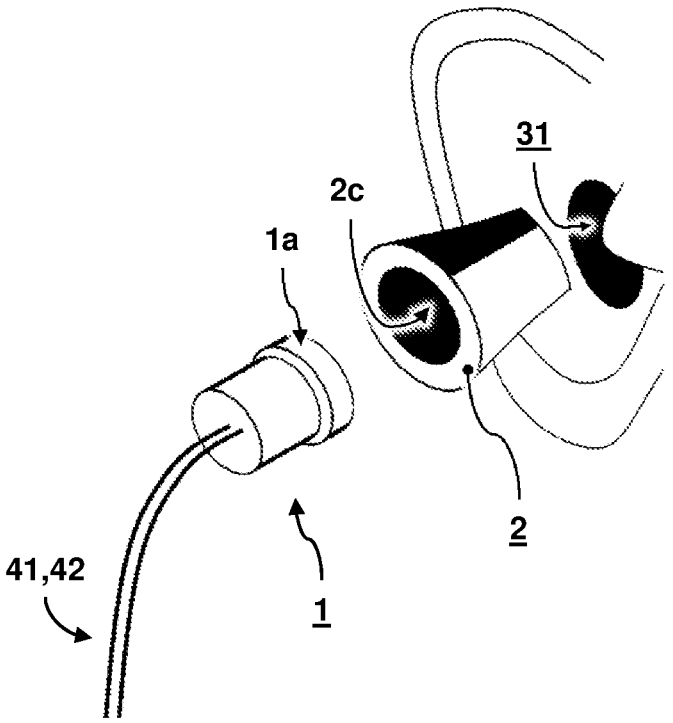
FIGS. 3A and 3B show the connecting of a test housing to an ear mould.
Figure 3B:
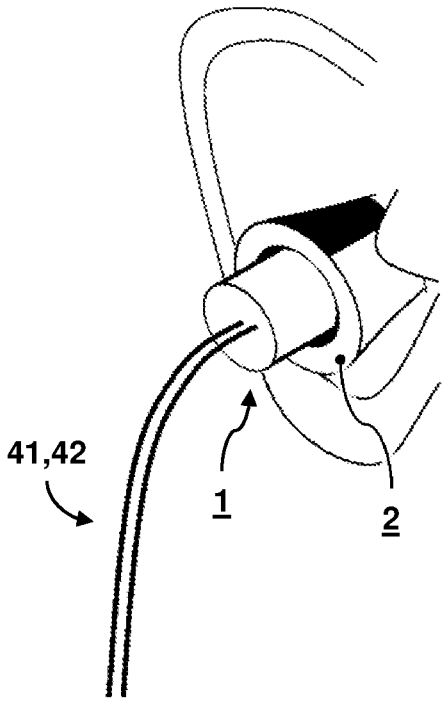

FIGS. 3A and 3B show the connecting of a test housing 1 to an ear mould 2. The test housing 1 comprises an outer contour 1*a* that fits into the inner contour of the ear mould 2. The open end of the test housing 1 (not visible here) connects to the inner passage 2*c* of the ear mould 2 such that the acoustic generator and microphone (not visible here) inside the test housing 1 are in acoustic communication with the ear canal 31. The test housing 1 is connected by wiring 41, 42 to send and receive test signals to and from the acoustic generator and microphone, respectively.

Figure 4:
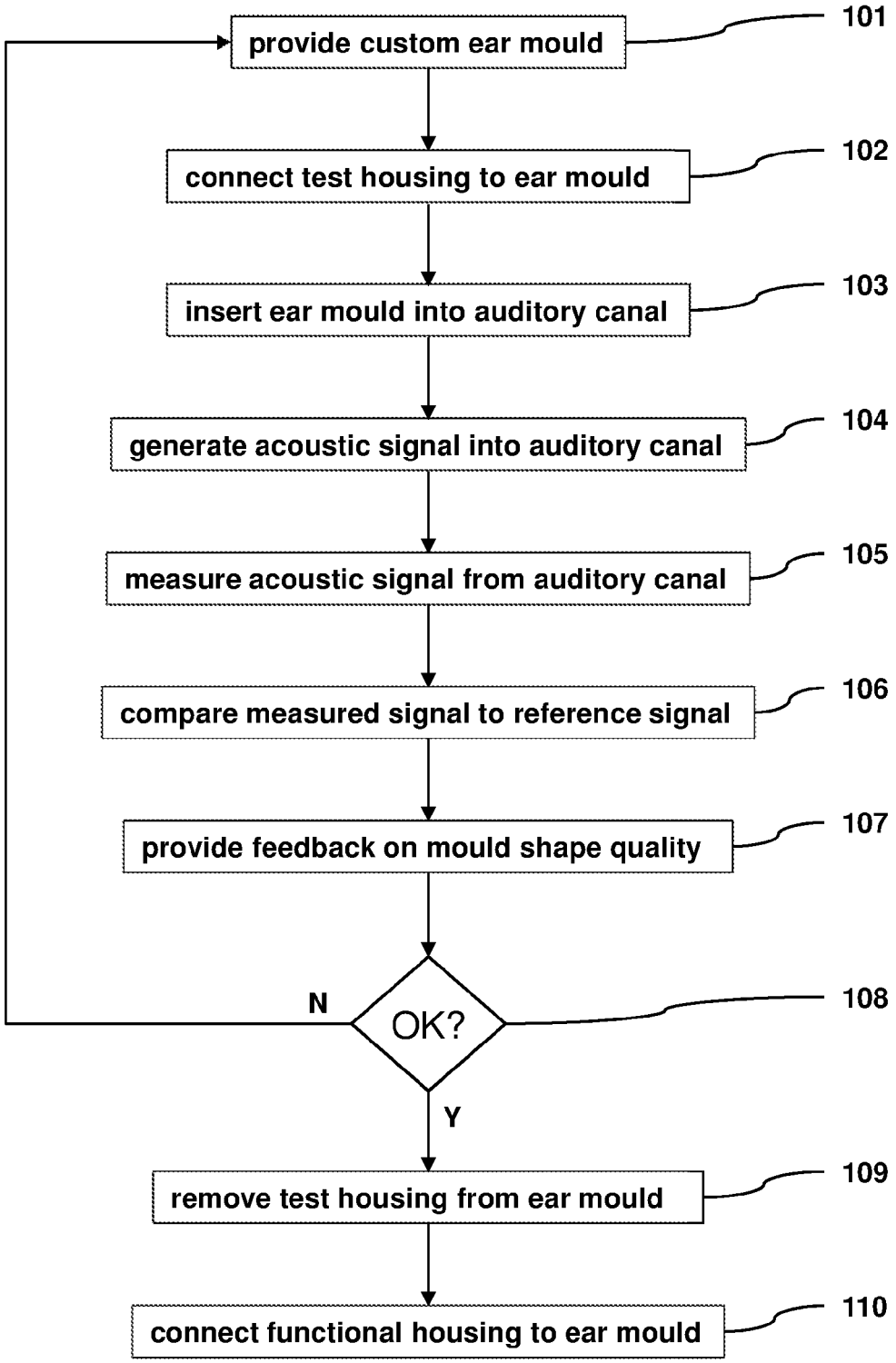
FIG. 4 shows a flow diagram of a method for testing a mould shape quality and building an ear piece.

FIG. 4 shows a flow diagram of a method for testing a mould shape quality and building an ear piece.

In step 101, a custom ear mould is provided. In step 102, a test housing is connected to the custom ear mould. In step 103, the ear mould is inserted into the auditory canal of a user. In step 104, an acoustic signal is generated into the auditory canal, e.g. by an acoustic generator in the test housing. In step 105, the acoustic signal is measured from the auditory canal. In step 106, the measured signal is compared to a reference signal. In step 107, a feedback is provided that indicates the mould shape quality. The feedback may e.g. comprise one or more of a visual, audio, or haptic feedback. In step 108, it is decided whether the mould shape quality is okay. If this is not the case, the method reverts to step 101, wherein another or modified custom ear mould is provided. If the mould shape quality is okay, the method proceeds to step 109. In step 109, the test housing is removed from the custom ear mould. In step 110, a functional housing is connected to the custom ear mould. The ear piece with the functional housing is now ready for the end-user.

Of course, it will be understood that the method is not limited to the indicated sequence of steps of the flow diagram but includes any logical variation or combination. For example, the steps 102 and 103 may be reversed, i.e. the ear mould can be first put in the ear (step 103) and the test housing connected subsequently (step 102). Also some steps may be executed simultaneously. For example, steps 104 and 105 are typically performed simultaneously, i.e. the sound is measured as it is generated. Also steps 106 through 107 may be performed simultaneous with steps 104 and 105, i.e. the feedback is provided while the system is still generating the test signal.

One method for providing an earpiece with a customized ear mould acoustically fitting into the ear canal of an ear comprises providing the customized ear mould; testing a mould shape quality of the ear mould as described herein above; and replacing the test housing of the mould testing system with a functional housing of the ear piece (e.g. shown in FIG. 2) when the mould shape quality conforms to a reference quality measure.

In one embodiment, mould shape quality test is performed at the moment a custom solution (customized ear moulds) is provided to an end-user, carried out by a vendor with the testing equipment 100 as described herein.

In the following, a couple of different embodiments of the test housing are described, that typically lead to the situation that a sound is played by a receiver and the sound is measured by a microphone in the same volume, i.e. the volume consisting of the ear volume before the eardrum and the ear mould canal.

Figure 5A:
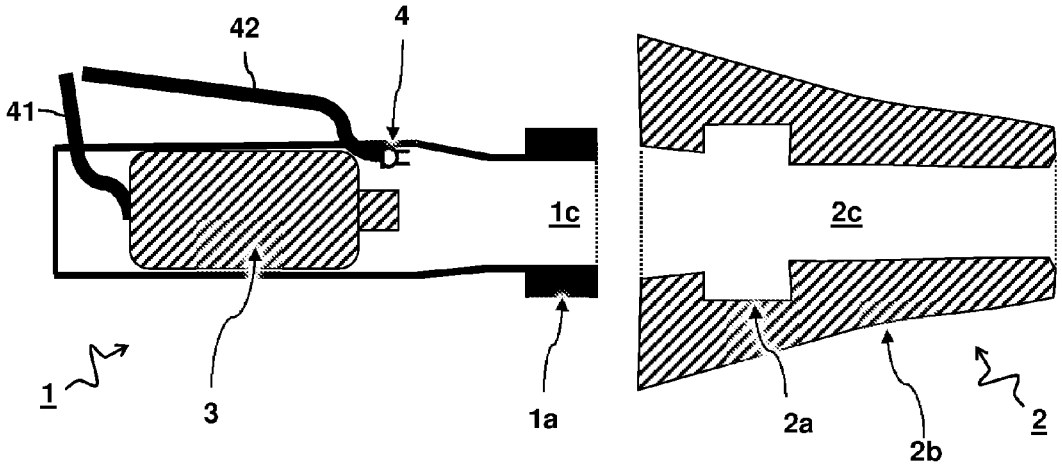
FIG. 5A shows a first embodiment of a test housing and an ear mould.

FIG. 5A shows a first embodiment of a test housing 1 and an ear mould 2. The test housing 1 comprises wiring 41 connected to acoustic generator 3 and wiring 42 connected to microphone 4. The test housing 1 can be connected to the ear mould 2 by means of the outer contour 1*a* fitting into the clamping structure 2*a*. The ear mould 2 comprises an outer contour 2*b* that is custom designed to acoustically fit into an ear canal (not shown here). When connected, the microphone 4 allows to measure sound played with the acoustic generator 3, also referred to as a receiver or loudspeaker. In particular, in the embodiment shown, the microphone 4 is capable of measuring the sound level in the sound path between the loudspeaker and the eardrum, at least when the test housing 1 is connected to the ear mould 2.

Figure 5B:
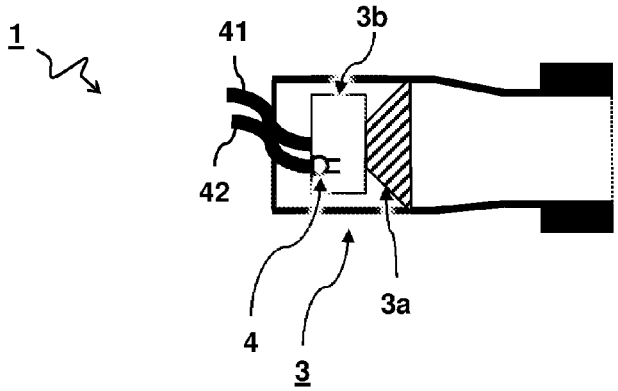
FIG. 5B shows a second embodiment of a test housing comprising a moving coil driver with a microphone enclosed in the back volume.

FIG. 5B shows a second embodiment of a test housing 1 comprising a moving coil driver as the acoustic generator 3 with a microphone 4 enclosed in the back volume. The acoustic generator 3 comprises a cone 3*a* and magnet 3*b*. The acoustic generator 3 is connected by wiring 41 and the microphone 4 is connected by wiring 42. In the embodiment, the microphone 4 is integrated in or situated just behind the receiver unit, i.e. acoustic generator 3, measuring the sound in the loudspeaker's inner volume that is acoustically connected to the chamber of the test housing behind the moving coil unit.

Figure 5C:
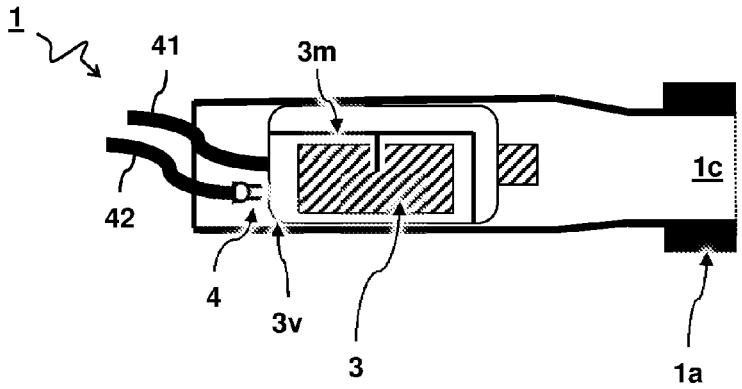
FIG. 5C shows a third embodiment of a test housing comprising a balanced armature receiver with a microphone connected to the vent.

FIG. 5C shows a third embodiment of a test housing 1 wherein the acoustic generator 3 comprises a balanced armature receiver. In the embodiment, the microphone 4 is situated in the chamber of the test housing behind the receiver unit 3 acoustically connected to the receiver unit through its vent 3*v* measuring the sound in the chamber behind the loudspeaker unit.

In one embodiment, the microphone 4 is located opposite the acoustic generator 3 with respect to the open end 1*c* of the housing 1. In other words, the acoustic generator 3 is arranged between the microphone 4 and the open end 1*c*. In this way, the wiring 42 connecting to the microphone 4 does not have to pass the acoustic generator 3. An advantage of having the microphone 4 located opposite the acoustic generator 3 with respect to the open end 1*c*, e.g. as sketched in FIGS. 5B and 5C, is that the diameter of the test housing 1 can be smaller, which makes it easier to connect the test housing to customized ear moulds of users with a relatively small concha (ear shells) or ear opening. Moreover, in a test housing with a specific diameter a bigger receiver can be used.

Figure 6A:
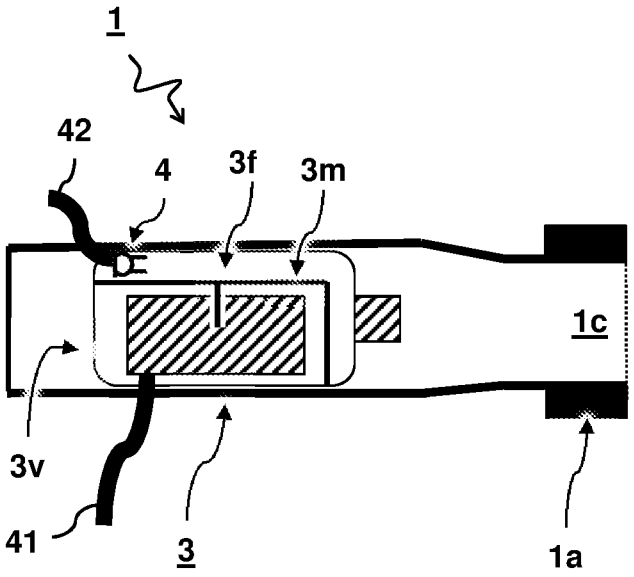
FIG. 6A shows a fourth embodiment of a test housing comprising a balanced armature receiver with a microphone enclosed in the front chamber above the membrane.

FIG. 6A shows a fourth embodiment of a test housing 1 wherein the acoustic generator 3 comprises a balanced armature receiver. In the embodiment, the microphone 4 is integrated in the receiver 3 measuring the sound in the front chamber 3*f*, above the membrane 3*m*, connected to the sound outlet of the balanced armature receiver 3. The receiver 3 also comprises a vent 3*v*.

Figure 6B:
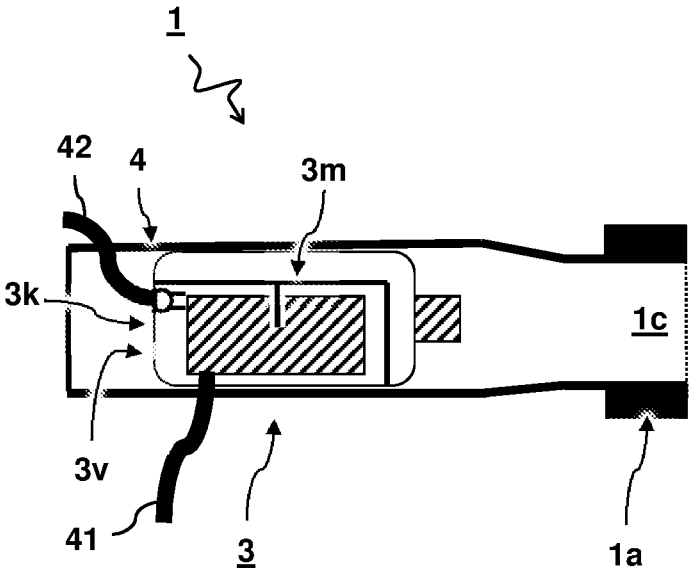
FIG. 6B shows a fifth embodiment of a test housing comprising a balanced armature receiver with a microphone enclosed in the back chamber below the membrane.

FIG. 6B shows a fifth embodiment of a test housing 1 comprising a balanced armature receiver 3 with a microphone 4. In the embodiment, the microphone 4 is integrated in the receiver 3 measuring the sound in the back chamber 3*k* below the membrane 3*m* of a balanced armature receiver. The receiver 3 may comprise an optional vent 3*v*.

Figure 7A:
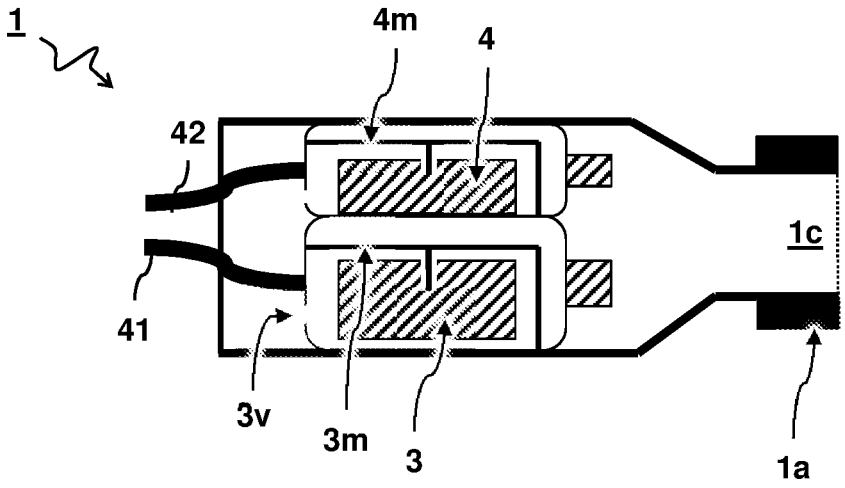
FIG. 7A shows a sixth embodiment of a test housing comprising a two balanced armature receivers (dual driver)

FIG. 7A shows a sixth embodiment of a test housing 1. In the embodiment, the test housing 1 comprises two balanced armature receivers 3 and 4 (dual driver), for higher frequencies and lower frequencies playback. Each receiver comprises a respective membrane 3*m*,4*m*. During the mould quality testing, the higher frequencies balanced armature receiver is used as a microphone 4. The lower frequency receiver is uses as the acoustic generator 3. Thereto, the wiring 41 is used to provide a test signal to the acoustic generator 3 while the wiring 42 is used to monitor the test signal as received by the high frequency 'receiver', in this case used as microphone 4.

Accordingly, in one embodiment, the test housing 1 comprises a dual driver in ear monitor comprising a low frequency driver 3 and a high frequency driver 4. During testing of the mould shape quality Q, the low frequency driver is arranged as the acoustic generator 3 and the high frequency driver is arranged as the microphone 4. During customer use of the ear piece, the low frequency driver and a high frequency driver are both arranged for generating sound. Accordingly, the mould quality testing can be done by rewiring the high frequency driver to act as microphone.

In one embodiment, the test housing 1 is obtained by a reversible adaptation of the earpiece 10 that is intended for customer use. In a further embodiment, the adaptation comprises provision of a cable that connects to at least two extra wires, for contacting the high frequency driver. The extra wires are not necessarily used during regular customer use of the ear piece. In a further embodiment, the dual driver in ear monitor comprises an extra microphone for measuring an acoustic signal Sr from the ear canal and in which the cable connects to the microphone In one embodiment, a method for providing an earpiece comprising a customized dual driver in ear monitor 2 acoustically fitting into an ear canal 31 of an ear, comprises: providing the earpiece 2; testing the mould shape quality Q of the ear mould 2 according to a method as described above; and cancelling or reversing the adaptation to provide the earpiece ready for normal customer use when the mould shape quality Q conforms to a reference quality measure.

One specific embodiment consists of a so-called dual driver In Ear Monitor (IEM). The earphone has two balance armature receivers (BAR): one for higher frequencies (tweeter) and one for lower frequencies (sub). Normally, the tweeter is connected to a listening device through a low pass filter. However, in this embodiment, the tweeter BAR is used as a microphone. In this case, vibrations of the sound (as created by the sub BAR) move the membrane in the tweeter BAR, resulting in a small current on the input of the tweeter. The low-impedance output, as measured on the input of the tweeter BAR, should be changed to a high-impedance output to measure sound in the ear volume. In general, an IEM is used with a standard stereo jack connector. When allowing for in-situ mould shape quality testing with an IEM, a different 5 wire socket can be used on the IEM, that has extra wires for measuring the sound with the tweeter BAR in both the left and right ear. The standard Jack connector should than only be connected to 3 of the 5 wires of the socket. In case e.g. mould shape quality testing is done at the store that sells the IEM, the Vendor connects a 5 wire cable to the socket, which allows him to measure whether both IEM have a good acoustical shape fit. If this is the case, the test cable can be removed and the standard stereo cable can be placed. Accordingly, with the addition of a special socket the functionality of a hifi IEM, can be extended with mould shape quality testing feature. Especially in the case of a custom IEM, this is a big advantage, because the shape conformity cannot be tested in another way. One other embodiment uses as hardware for the receiver and microphone function, one of the integrated dual driver types AcuPass 1723 from Sonion. With this device the tweeter BAR (part) is used as Microphone as above.

Figure 7B:
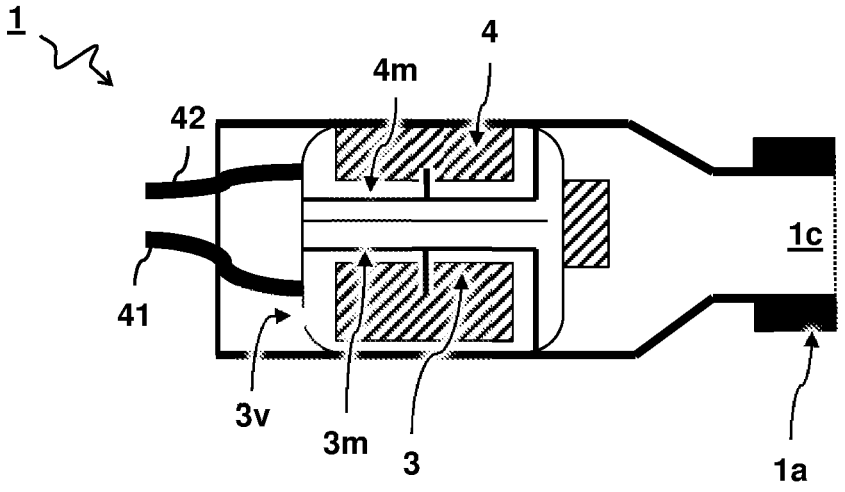
FIG. 7B shows a seventh embodiment of a test housing comprising one dual driving balanced armature receiver.

FIG. 7B shows a seventh embodiment of the test housing 1. Different from FIG. 7A, the housing comprises one dual driving balanced armature receiver for both higher frequencies and lower frequencies playback, from which the higher frequencies' part is used as a microphone 4 and the lower frequencies' part is used as acoustic generator 3.

One advantage of the embodiments comprising a dual driver IEM (either 2 BAR's or 1 dual BAR) is that the mould shape quality of an IEM can be measured with a minimal adaptation of the device. This may be contrasted with conventional (over-/under-) pressure measurements to test mould shape quality of the IEM which may require providing an extra channel in the IEM that is later closed off for customer use.

While the present systems and methods have been described in particular detail with reference to specific exemplary embodiments thereof, it should also be appreciated that numerous modifications and alternative embodiments may be devised by those having ordinary skill in the art without departing from the scope of the present disclosure. For example, embodiments wherein devices or systems are disclosed to be arranged and/or constructed for performing a specified method or function inherently disclose the method or function as such and/or in combination with other disclosed embodiments of methods or systems. Furthermore, embodiments of methods are considered to inherently disclose their implementation in respective hardware, where possible, in combination with other disclosed embodiments of methods or systems. Furthermore, methods that can be embodied as program instructions, e.g. on a non-transient computer-readable storage medium, are considered inherently disclosed as such embodiment.

Finally, the above-discussion is intended to be merely illustrative of the present systems and/or methods and should not be construed as limiting the appended claims to any particular embodiment or group of embodiments. The specification and drawings are accordingly to be regarded in an illustrative manner and are not intended to limit the scope of the appended claims. In interpreting the appended claims, it should be understood that the word "comprising" does not exclude the presence of other elements or acts than those listed in a given claim; the word "a" or "an" preceding an element does not exclude the presence of a plurality of such elements; any reference signs in the claims do not limit their scope; several "means" may be represented by the same or different item(s) or implemented structure or function; any of the disclosed devices or portions thereof may be combined together or separated into further portions unless specifically stated otherwise. The mere fact that certain measures are recited in mutually different claims does not indicate that a combination of these measures cannot be used to advantage. In particular, all working combinations of the claims are considered inherently disclosed.

The invention claimed is:

1. A method for testing a mould shape quality of an ear mould customized to an ear canal of a user by means of a mould testing system, wherein the customized ear mould comprises an outer contour moulded to conform with the ear canal; and an inner passage through the customized ear mould that is in use directed into the ear canal to be in acoustic communication therewith; and the mould testing system comprises an acoustic generator and a microphone arranged in a test housing with an open end that is connectable to the inner passage of the ear mould; wherein the test housing is configured to form a closed volume with the ear canal sealed by the ear mould, wherein the closed volume comprises the acoustic generator and the microphone;

and wherein the method comprises:

inserting the ear mould into the ear canal;

connecting the test housing with the open end to the inner passage of the ear mould;

using the acoustic generator to generate an acoustic signal with a first test frequency and a second test frequency, the second test frequency being different from the first test frequency, into the ear canal via the inner passage;

using the microphone to measure a result of the acoustic signal at the first test frequency and the second test frequency from the ear canal;

calculating a measure for the mould shape quality of the customized ear mould based on a comparison of an intensity of the measured signal at the first test frequency with an intensity of the measured signal at the second test frequency; and providing a feedback signal based on the calculated measure for the mould shape quality of the customized ear mould.

2. The method according to claim 1, wherein the test housing is reversibly connectable to the customized ear mould to form the closed volume with the ear canal.

3. The method according to claim 1, wherein the first test frequency is in a low frequency range between 15-50 Hz.

4. The method according to claim 3, wherein the second test frequency is in a high frequency range above 100 Hz.

5. The method according to claim 1, wherein the acoustic generator is arranged between the microphone and the open end.

6. The method according to claim 1, wherein the inner passage of the customized ear mould comprises a clamping structure arranged for holding a functional housing of the earpiece into the inner passage; wherein the test housing comprises an outer contour that fits to the clamping structure for connecting the test housing with the open end to the inner passage.

7. The method according to claim 1, wherein the clamping structure and/or outer contour comprises a rim that fits into an opposing slot.

8. The method according to claim 1, wherein the test housing is obtained by a reversible adaptation of an earpiece for customer use, which earpiece comprises a dual driver in ear monitor comprising a low frequency driver and a high frequency driver; wherein, during testing of the mould shape quality, the low frequency driver is arranged as the acoustic generator and the high frequency driver is arranged as the microphone, and wherein, during customer use of the ear piece, the low frequency driver and a high frequency driver are both arranged for generating sound.

9. The method according to claim 8, in which the adaptation comprises provision of a cable that connects to at least two wires, for contacting the high frequency driver, which two wires are not used during customer use.

10. The method according to claim 9, in which the dual driver in ear monitor comprises an extra microphone for measuring the acoustic signal from the ear canal and in which the cable connects to the microphone.

11. The method according to claim 1, comprising providing a customized ear mould;

testing the mould shape quality of the ear mould; and replacing the test housing of the mould testing system with a functional housing of the ear piece when the mould shape quality conforms to a reference quality measure.

12. The method according to claim 8, comprising providing the earpiece;

testing the mould shape quality of the ear mould;

cancelling or reversing the adaptation to render the earpiece suitable for customer use when the mould shape quality conforms to a reference quality measure.

13. The method according to claim 12, wherein the functional housing comprises an acoustic generator connectable to one of a hearing aid hearing protector, single driver In Ear Monitor, or headset.

14. A mould testing system for determining a mould shape quality of an ear mould customized to an ear canal of a user, wherein the ear mould comprises an outer contour moulded to conform with the ear canal; and an inner passage through the ear mould that is in use directed into the ear canal to be in acoustic communication therewith; and the mould testing system comprises an acoustic generator and a microphone arranged in a test housing with an open end that is connectable to the inner passage of the ear mould; wherein the test housing is configured to form a closed volume with the ear canal sealed by the ear mould, wherein the closed volume comprises the acoustic generator and the microphone; the mould testing system further comprising a signal generator configured to provide a driving signal to the acoustic generator for generating an acoustic signal with a first test frequency and a second test frequency, the second test frequency being different from the first test frequency;

a signal receiver configured to receive a measured signal at the first test frequency and the second test frequency from the microphone based on a registered signal by the microphone at the first test frequency and the second test frequency resulting from the generated acoustic signal at the first test frequency and the second test frequency; and a feedback circuit configured to compare an intensity of the measured signal at the first test frequency with an intensity of the measured signal at the second test frequency and to provide a feedback signal based on the said comparison wherein the feedback signal is a measure for the mould shape quality of the ear mould.

15. The system according to claim 14, wherein the test housing is reversibly connectable to the ear mould to form a closed volume with the ear canal, wherein the closed volume comprises the acoustic generator and the microphone.

16. The system according to claim 14, wherein the first test frequency is in a low frequency range between 15-50 Hz.

17. The system according to claim 14, wherein the second test frequency is in a high frequency range above 100 Hz.

18. The system according to claim 14, wherein the inner passage of the customized ear mould comprises a clamping structure arranged for holding a functional housing of the earpiece into the inner passage; wherein the test housing comprises an outer contour that fits to the clamping structure for connecting the test housing with the open end to the inner passage.

19. The system according to claim 14, wherein the test housing comprises a dual driver in ear monitor comprising a low frequency driver and a high frequency driver; wherein, during testing of the mould shape quality, the low frequency driver is arranged as the acoustic generator and the high frequency driver is arranged as the microphone, and wherein, during customer use, the low frequency driver and a high frequency driver are both arranged for generating sound.

* * * * *